US009609416B2

(12) United States Patent
Kaller et al.

(10) Patent No.: US 9,609,416 B2
(45) Date of Patent: Mar. 28, 2017

(54) HEADPHONE RESPONSIVE TO OPTICAL SIGNALING

(71) Applicant: Cirrus Logic, Inc., Austin, TX (US)

(72) Inventors: Roy Scott Kaller, Austin, TX (US); Aaron Brennan, Austin, TX (US)

(73) Assignee: CIRRUS LOGIC, INC., Austin, TX (US)

( * ) Notice: Subject to any disclaimer, the term of this patent is extended or adjusted under 35 U.S.C. 154(b) by 95 days.

(21) Appl. No.: 14/299,836

(22) Filed: Jun. 9, 2014

(65) Prior Publication Data

US 2015/0358718 A1 Dec. 10, 2015

(51) Int. Cl.
*H04R 1/10* (2006.01)
*G08G 1/0967* (2006.01)

(52) U.S. Cl.
CPC ..... *H04R 1/1041* (2013.01); *G08G 1/096791* (2013.01); *H04R 1/1083* (2013.01)

(58) Field of Classification Search
CPC .. H04R 1/1091; H04R 1/1041; H04R 1/1083; H03G 3/32; H03G 3/30; G03G 1/096791
See application file for complete search history.

(56) References Cited

U.S. PATENT DOCUMENTS 3,550,078 A 12/1970 Long
3,831,039 A 8/1974 Henschel
5,044,373 A 9/1991 Northeved et al.
5,172,113 A 12/1992 Hamer
5,187,476 A 2/1993 Hamer
5,251,263 A 10/1993 Andrea et al.
5,278,913 A 1/1994 Delfosse et al.
5,321,759 A 6/1994 Yuan
5,337,365 A 8/1994 Hamabe et al.
5,359,662 A 10/1994 Yuan et al.
5,410,605 A 4/1995 Sawada et al.
5,425,105 A 6/1995 Lo et al.
5,445,517 A 8/1995 Kondou et al.
(Continued)

FOREIGN PATENT DOCUMENTS

DE 102011013343 A1 9/2012
EP 1880699 A2 1/2008
(Continued)

OTHER PUBLICATIONS

U.S. Appl. No. 13/686,353, Hendrix et al.
(Continued)

*Primary Examiner* — Sonia Gay
(74) *Attorney, Agent, or Firm* — Norton Rose Fulbright US LLP

(57) ABSTRACT

An optical sensor may be integrated into headphones and feedback from the sensor used to adjust an audio output from the headphones. For example, an emergency vehicle traffic preemption signal may be detected by the optical sensor. Optical signals may be processed in a pattern discriminator, which may be integrated with an audio controller integrated circuit (IC). When the signal is detected, the playback of music through the headphones may be muted and/or a noise cancellation function turned off. The optical sensor may be integrated in a music player, a smart phone, a tablet, a cord-mounted module, or the earpieces of the headphones.

23 Claims, 5 Drawing Sheets

(56) References Cited

U.S. PATENT DOCUMENTS 5,465,413 A 11/1995 Enge et al.
5,495,243 A 2/1996 McKenna
5,548,681 A 8/1996 Gleaves et al.
5,586,190 A 12/1996 Trantow et al.
5,640,450 A 6/1997 Watanabe
5,699,437 A 12/1997 Finn
5,706,344 A 1/1998 Finn
5,740,256 A 4/1998 Castello Da Costa et al.
5,768,124 A 6/1998 Stothers et al.
5,815,582 A 9/1998 Claybaugh et al.
5,832,095 A 11/1998 Daniels
5,946,391 A 8/1999 Dragwidge et al.
5,991,418 A 11/1999 Kuo
6,041,126 A 3/2000 Terai et al.
6,118,878 A 9/2000 Jones
6,219,427 B1 4/2001 Kates et al.
6,278,786 B1 8/2001 McIntosh
6,282,176 B1 8/2001 Hemkumar
6,326,903 B1 12/2001 Gross et al.
6,418,228 B1 7/2002 Terai et al.
6,434,246 B1 8/2002 Kates et al.
6,434,247 B1 8/2002 Kates et al.
6,522,746 B1 2/2003 Marchok et al.
6,683,960 B1 1/2004 Fujii et al.
6,766,292 B1 7/2004 Chandran et al.
6,768,795 B2 7/2004 Feltstrom et al.
6,850,617 B1 2/2005 Weigand
6,940,982 B1 9/2005 Watkins
7,058,463 B1 6/2006 Ruha et al.
7,103,188 B1 9/2006 Jones
7,181,030 B2 2/2007 Rasmussen et al.
7,330,739 B2 2/2008 Somayajula
7,365,669 B1 4/2008 Melanson
7,446,674 B2 11/2008 McKenna
7,680,456 B2 3/2010 Muhammad et al.
7,742,790 B2 6/2010 Konchitsky et al.
7,817,808 B2 10/2010 Konchitsky et al.
7,903,825 B1 3/2011 Melanson
8,019,050 B2 9/2011 Mactavish et al.
D666,169 S 8/2012 Tucker et al.
8,249,262 B2 8/2012 Chua et al.
8,251,903 B2 8/2012 LeBoeuf et al.
8,290,537 B2 10/2012 Lee et al.
8,325,934 B2 12/2012 Kuo
8,379,884 B2 2/2013 Horibe et al.
8,401,200 B2 3/2013 Tiscareno et al.
8,442,251 B2 5/2013 Jensen et al.
8,526,627 B2 9/2013 Asao et al.
8,848,936 B2 9/2014 Kwatra et al.
8,907,829 B1 12/2014 Naderi
8,908,877 B2 12/2014 Abdollahzadeh Milani et al.
8,948,407 B2 2/2015 Alderson et al.
8,958,571 B2 2/2015 Kwatra et al.
2001/0053228 A1 12/2001 Jones
2002/0003887 A1 1/2002 Zhang et al.
2003/0063759 A1 4/2003 Brennan et al.
2003/0185403 A1 10/2003 Sibbald
2004/0047464 A1 3/2004 Yu et al.
2004/0165736 A1 8/2004 Hetherington et al.
2004/0167777 A1 8/2004 Hetherington et al.
2004/0202333 A1 10/2004 Csermak et al.
2004/0264706 A1 12/2004 Ray et al.
2005/0004796 A1 1/2005 Trump et al.
2005/0018862 A1 1/2005 Fisher
2005/0117754 A1 6/2005 Sakawaki
2005/0207585 A1 9/2005 Christoph
2005/0240401 A1 10/2005 Ebenezer
2006/0035593 A1 2/2006 Leeds
2006/0069556 A1 3/2006 Nadjar et al.
2006/0153400 A1 7/2006 Fujita et al.
2007/0030989 A1 2/2007 Kates
2007/0033029 A1 2/2007 Sakawaki
2007/0038441 A1 2/2007 Inoue et al.
2007/0047742 A1 3/2007 Taenzer et al.
2007/0053524 A1 3/2007 Haulick et al.
2007/0076896 A1 4/2007 Hosaka et al.
2007/0127879 A1* 6/2007 Frank ..... H03G 3/32 386/234
2007/0154031 A1 7/2007 Avendano et al.
2007/0258597 A1 11/2007 Rasmussen et al.
2007/0297620 A1 12/2007 Choy
2008/0019548 A1 1/2008 Avendano
2008/0079571 A1* 4/2008 Samadani ..... G08B 21/02 340/552
2008/0101589 A1 5/2008 Horowitz et al.
2008/0107281 A1 5/2008 Togami et al.
2008/0144853 A1 6/2008 Sommerfeldt et al.
2008/0177532 A1 7/2008 Greiss et al.
2008/0181422 A1 7/2008 Christoph
2008/0226098 A1 9/2008 Haulick et al.
2008/0240455 A1 10/2008 Inoue et al.
2008/0240457 A1 10/2008 Inoue et al.
2009/0012783 A1 1/2009 Klein
2009/0034748 A1 2/2009 Sibbald
2009/0041260 A1 2/2009 Jorgensen et al.
2009/0046867 A1 2/2009 Clemow
2009/0060222 A1 3/2009 Jeong et al.
2009/0080670 A1 3/2009 Solbeck et al.
2009/0086990 A1 4/2009 Christoph
2009/0175466 A1 7/2009 Elko et al.
2009/0196429 A1 8/2009 Ramakrishnan et al.
2009/0220107 A1 9/2009 Every et al.
2009/0238369 A1 9/2009 Ramakrishnan et al.
2009/0245529 A1 10/2009 Asada et al.
2009/0254340 A1 10/2009 Sun et al.
2009/0290718 A1 11/2009 Kahn et al.
2009/0296965 A1 12/2009 Kojima
2009/0304200 A1 12/2009 Kim et al.
2009/0311979 A1 12/2009 Husted et al.
2010/0014683 A1 1/2010 Maeda et al.
2010/0014685 A1 1/2010 Wurm
2010/0061564 A1 3/2010 Clemow et al.
2010/0069114 A1 3/2010 Lee et al.
2010/0082339 A1 4/2010 Konchitsky et al.
2010/0098263 A1 4/2010 Pan et al.
2010/0098265 A1 4/2010 Pan et al.
2010/0124336 A1 5/2010 Shridhar et al.
2010/0124337 A1 5/2010 Wertz et al.
2010/0131269 A1 5/2010 Park et al.
2010/0150367 A1 6/2010 Mizuno
2010/0158330 A1 6/2010 Guissin et al.
2010/0166203 A1 7/2010 Peissig et al.
2010/0195838 A1 8/2010 Bright
2010/0195844 A1 8/2010 Christoph et al.
2010/0207317 A1 8/2010 Iwami et al.
2010/0239126 A1 9/2010 Grafenberg et al.
2010/0246855 A1 9/2010 Chen
2010/0266137 A1 10/2010 Sibbald et al.
2010/0272276 A1 10/2010 Carreras et al.
2010/0272283 A1 10/2010 Carreras et al.
2010/0274564 A1 10/2010 Bakalos et al.
2010/0284546 A1 11/2010 DeBrunner et al.
2010/0291891 A1 11/2010 Ridgers et al.
2010/0296666 A1 11/2010 Lin
2010/0296668 A1 11/2010 Lee et al.
2010/0310086 A1 12/2010 Magrath et al.
2010/0322430 A1 12/2010 Isberg
2011/0007907 A1 1/2011 Park et al.
2011/0106533 A1 5/2011 Yu
2011/0116687 A1* 5/2011 McDonald ..... G06K 9/00785 382/105
2011/0129098 A1 6/2011 Delano et al.
2011/0130176 A1 6/2011 Magrath et al.
2011/0142247 A1 6/2011 Fellers et al.
2011/0144984 A1 6/2011 Konchitsky
2011/0158419 A1 6/2011 Theverapperuma et al.
2011/0206214 A1 8/2011 Christoph et al.
2011/0222698 A1 9/2011 Asao et al.
2011/0249826 A1 10/2011 Van Leest
2011/0273374 A1* 11/2011 Wood ..... H04M 1/0235 345/169
2011/0288860 A1 11/2011 Schevciw et al.
2011/0293103 A1 12/2011 Park et al.
2011/0299695 A1 12/2011 Nicholson

(56) References Cited

U.S. PATENT DOCUMENTS

| | | | | |
|---|---|---|---|---|
| 2011/0305347 | A1 | 12/2011 | Wurm | |
| 2011/0317848 | A1 | 12/2011 | Ivanov et al. | |
| 2012/0120287 | A1* | 5/2012 | Funamoto | H04N 5/335 348/246 |
| 2012/0135787 | A1 | 5/2012 | Kusunoki et al. | |
| 2012/0140917 | A1 | 6/2012 | Nicholson et al. | |
| 2012/0140942 | A1 | 6/2012 | Loeda | |
| 2012/0140943 | A1 | 6/2012 | Hendrix et al. | |
| 2012/0148062 | A1 | 6/2012 | Scarlett et al. | |
| 2012/0155666 | A1 | 6/2012 | Nair | |
| 2012/0170766 | A1 | 7/2012 | Alves et al. | |
| 2012/0207317 | A1 | 8/2012 | Abdollahzadeh Milani et al. | |
| 2012/0215519 | A1 | 8/2012 | Park et al. | |
| 2012/0250873 | A1 | 10/2012 | Bakalos et al. | |
| 2012/0259626 | A1 | 10/2012 | Li et al. | |
| 2012/0263317 | A1 | 10/2012 | Shin et al. | |
| 2012/0281850 | A1 | 11/2012 | Hyatt | |
| 2012/0300958 | A1 | 11/2012 | Klemmensen | |
| 2012/0300960 | A1 | 11/2012 | Mackay et al. | |
| 2012/0308021 | A1 | 12/2012 | Kwatra et al. | |
| 2012/0308024 | A1 | 12/2012 | Alderson et al. | |
| 2012/0308025 | A1 | 12/2012 | Hendrix et al. | |
| 2012/0308026 | A1 | 12/2012 | Kamath et al. | |
| 2012/0308027 | A1 | 12/2012 | Kwatra | |
| 2012/0308028 | A1 | 12/2012 | Kwatra et al. | |
| 2012/0310640 | A1 | 12/2012 | Kwatra et al. | |
| 2013/0010982 | A1 | 1/2013 | Elko et al. | |
| 2013/0083939 | A1 | 4/2013 | Fellers et al. | |
| 2013/0243198 | A1 | 9/2013 | Van Rumpt | |
| 2013/0243225 | A1 | 9/2013 | Yokota | |
| 2013/0272539 | A1 | 10/2013 | Kim et al. | |
| 2013/0287218 | A1 | 10/2013 | Alderson et al. | |
| 2013/0287219 | A1 | 10/2013 | Hendrix et al. | |
| 2013/0293723 | A1* | 11/2013 | Benson | G02B 27/017 348/164 |
| 2013/0301842 | A1 | 11/2013 | Hendrix et al. | |
| 2013/0301846 | A1 | 11/2013 | Alderson et al. | |
| 2013/0301847 | A1 | 11/2013 | Alderson et al. | |
| 2013/0301848 | A1 | 11/2013 | Zhou et al. | |
| 2013/0301849 | A1 | 11/2013 | Alderson et al. | |
| 2013/0343556 | A1 | 12/2013 | Bright | |
| 2013/0343571 | A1 | 12/2013 | Rayala et al. | |
| 2014/0044275 | A1 | 2/2014 | Goldstein et al. | |
| 2014/0050332 | A1 | 2/2014 | Nielsen et al. | |
| 2014/0086425 | A1 | 3/2014 | Jensen et al. | |
| 2014/0177851 | A1 | 6/2014 | Kitazawa et al. | |
| 2014/0185828 | A1* | 7/2014 | Helbling | H03G 5/165 381/103 |
| 2014/0211953 | A1 | 7/2014 | Alderson et al. | |
| 2014/0226827 | A1 | 8/2014 | Abdollahzadeh Milani | |
| 2014/0254830 | A1* | 9/2014 | Tomono | H04R 1/1041 381/107 |
| 2014/0270222 | A1 | 9/2014 | Hendrix et al. | |
| 2014/0270223 | A1 | 9/2014 | Li et al. | |
| 2014/0270224 | A1 | 9/2014 | Zhou et al. | |
| 2014/0270248 | A1* | 9/2014 | Ivanov | H04R 3/005 381/92 |
| 2014/0314246 | A1 | 10/2014 | Hellman | |
| 2015/0092953 | A1 | 4/2015 | Abdollahzadeh Milani et al. | |
| 2015/0104032 | A1 | 4/2015 | Kwatra et al. | |

FOREIGN PATENT DOCUMENTS

| | | | |
|---|---|---|---|
| EP | 1947642 | A1 | 7/2008 |
| EP | 2133866 | A1 | 12/2009 |
| EP | 2216774 | A1 | 8/2010 |
| EP | 2395500 | A1 | 12/2011 |
| EP | 2395501 | A1 | 12/2011 |
| GB | 2401744 | A | 11/2004 |
| GB | 2455821 | A | 6/2009 |
| GB | 2455824 | A | 6/2009 |
| GB | 2455828 | A | 6/2009 |
| GB | 2484722 | A | 4/2012 |
| JP | H06186985 | A | 7/1994 |
| WO | 03015074 | A1 | 2/2003 |
| WO | 03015275 | A1 | 2/2003 |
| WO | 2004009007 | A1 | 1/2004 |
| WO | 2004017303 | A1 | 2/2004 |
| WO | 2007/007916 | A1 | 1/2007 |
| WO | 2007/113487 | A1 | 10/2007 |
| WO | 2010/117714 | A1 | 10/2010 |
| WO | 2012/134874 | A1 | 10/2012 |

OTHER PUBLICATIONS

U.S. Appl. No. 13/721,832, Lu et al.
U.S. Appl. No. 13/724,656, Lu et al.
U.S. Appl. No. 13/794,931, Lu et al.
U.S. Appl. No. 13/794,979, Alderson et al.
U.S. Appl. No. 13/968,007, Hendrix et al.
U.S. Appl. No. 13/968,013, Abdollahzadeh Milani et al.
U.S. Appl. No. 14/101,777, Alderson et al.
U.S. Appl. No. 14/101,955, Alderson.
U.S. Appl. No. 14/197,814, Kaller et al.
U.S. Appl. No. 14/210,537, Abdollahzadeh Milani et al.
U.S. Appl. No. 14/210,589, Abdollahzadeh Milani et al.
U.S. Appl. No. 14/252,235, Lu et al.
Emergency Vehicle Strobe Detector, Hoover Fence, http://www.hooverfence.com/catalog/entry_systems/fs2000.htm.
Global Traffic Technologies Data sheet for Opticom™ Infrared System Model 792 Emitter, Oct. 2007.
Global Traffic Technologies Data sheet for Opticom™ Model 792M Multimode Strobe Emitter.
Global Traffic Technologies Data sheet for Opticom™ Infrared System Model 794 LED Emitter.
Global Traffic Technologies Data sheet for Opticom™ Model 794M Multimode LED Emitter.
Chapter 4 of the 2003 Manual on Uniform Traffic Control Devices (MUTCD) with Revision 1 only, Nov. 2004.
Benet et al., Using infrared sensors for distance measurement in mobile roots, Robotics and Autonomous Systems, 2002, vol. 40, pp. 255-266.
Campbell, Mikey, "Apple looking into self-adjusting earbud headphones with noise cancellation tech", Apple Insider, Jul. 4, 2013, pp. 1-10 (10 pages in pdf), downloaded on May 14, 2014 from http://appleinsider.com/articles/13/07/04/apple-looking-into-self-adjusting-earbud-headphones-with-noise-cancellation-tech.
Pfann, et al., "LMS Adaptive Filtering with Delta-Sigma Modulated Input Signals," IEEE Signal Processing Letters, Apr. 1998, pp. 95-97, vol. 5, No. 4, IEEE Press, Piscataway, NJ.
Toochinda, et al. "A Single-Input Two-Output Feedback Formulation for ANC Problems," Proceedings of the 2001 American Control Conference, Jun. 2001, pp. 923-928, vol. 2, Arlington, VA.
Kuo, et al., "Active Noise Control: A Tutorial Review," Proceedings of the IEEE, Jun. 1999, pp. 943-973, vol. 87, No. 6, IEEE Press, Piscataway, NJ.
Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.
Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.
Mali, Dilip, "Comparison of DC Offset Effects on LMS Algorithm and its Derivatives," International Journal of Recent Trends in Engineering, May 2009, pp. 323-328, vol. 1, No. 1, Academy Publisher.
Kates, James M., "Principles of Digital Dynamic Range Compression," Trends in Amplification, Spring 2005, pp. 45-76, vol. 9, No. 2, Sage Publications.
Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.
Silva, et al., "Convex Combination of Adaptive Filters With Different Tracking Capabilities," IEEE International Conference on Acoustics, Speech, and Signal Processing, Apr. 15-20, 2007, pp. III 925-928, vol. 3, Honolulu, HI, USA.

(56) References Cited

OTHER PUBLICATIONS

Akhtar, et al., "A Method for Online Secondary Path Modeling in Active Noise Control Systems," IEEE International Symposium on Circuits and Systems, May 23-26, 2005, pp. 264-267, vol. 1, Kobe, Japan.
Davari, et al., "A New Online Secondary Path Modeling Method for Feedforward Active Noise Control Systems," IEEE International Conference on Industrial Technology, Apr. 21-24, 2008, pp. 1-6, Chengdu, China.
Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.
Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.
Black, John W., "An Application of Side-Tone in Subjective Tests of Microphones and Headsets", Project Report No. NM 001 064. 01.20, Research Report of the U.S. Naval School of Aviation Medicine, Feb. 1, 1954, 12 pages (pp. 1-12 in pdf), Pensacola, FL, US.
Peters, Robert W., "The Effect of High-Pass and Low-Pass Filtering of Side-Tone Upon Speaker Intelligibility", Project Report No. NM 001 064.01.25, Research Report of the U.S. Naval School of Aviation Medicine, Aug. 16, 1954, 13 pages (pp. 1-13 in pdf), Pensacola, FL, US.
Lane, et al., "Voice Level: Autophonic Scale, Perceived Loudness, and the Effects of Sidetone", The Journal of the Acoustical Society of America, Feb. 1961, pp. 160-167, vol. 33, No. 2., Cambridge, MA, US.
Liu, et al., "Compensatory Responses to Loudness-shifted Voice Feedback During Production of Mandarin Speech", Journal of the Acoustical Society of America, Oct. 2007, pp. 2405-2412, vol. 122, No. 4.
Paepcke, et al., "Yelling in the Hall: Using Sidetone to Address a Problem with Mobile Remote Presence Systems", Symposium on User Interface Software and Technology, Oct. 16-19, 2011, 10 pages (pp. 1-10 in pdf), Santa Barbara, CA, US.
Therrien, et al., "Sensory Attenuation of Self-Produced Feedback: The Lombard Effect Revisited", PLOS ONE, Nov. 2012, pp. 1-7, vol. 7, Issue 11, e49370, Ontario, Canada.
Abdollahzadeh Milani, et al., "On Maximum Achievable Noise Reduction in Anc Systems",2010 IEEE International Conference on Acoustics Speech and Signal Processing, Mar. 14-19, 2010, pp. 349-352, Dallas, TX, US.
Cohen, Israel, "Noise Spectrum Estimation in Adverse Environments: Improved Minima Controlled Recursive Averaging", IEEE Transactions on Speech and Audio Processing, Sep. 2003, pp. 1-11, vol. 11, Issue 5, Piscataway, NJ, US.
Ryan, et al., "Optimum Near-Field Performance of Microphone Arrays Subject to a Far-Field Beampattern Constraint", J. Acoust. Soc. Am., Nov. 2000, pp. 2248-2255, 108 (5), Pt. 1, Ottawa, Ontario, Canada.
Cohen, et al., "Noise Estimation by Minima Controlled Recursive Averaging for Robust Speech Enhancement", IEEE Signal Processing Letters, Jan. 2002, pp. 12-15, vol. 9, No. 1, Piscataway, NJ, US.
Martin, Rainer, "Noise Power Spectral Density Estimation Based on Optimal Smoothing and Minimum Statistics", IEEE Transactions on Speech and Audio Processing, Jul. 2001, pp. 504-512, vol. 9, No. 5, Piscataway, NJ, US.
Martin, Rainer, "Spectral Subtraction Based on Minimum Statistics", Signal Processing VII Theories and Applications, Proceedings of EUSIPCO-94, 7th European Signal Processing Conference, Sep. 13-16, 1994, pp. 1182-1185, vol. III, Edinburgh, Scotland, U.K.
Booij, et al., "Virtual sensors for local, three dimensional, broadband multiple-channel active noise control and the effects on the quiet zones", Proceedings of the International Conference on Noise and Vibration Engineering, ISMA 2010, Sep. 20-22, 2010, pp. 151-166, Leuven.
Kuo, et al., "Residual noise shaping technique for active noise control systems", J. Acoust. Soc. Am. 95 (3), Mar. 1994, pp. 1665-1668.
Lopez-Caudana, Edgar Omar, "Active Noise Cancellation: The Unwanted Signal and the Hybrid Solution", Adaptive Filtering Applications, Dr. Lino Garcia (Ed.), Jul. 2011, pp. 49-84, ISBN: 978-953-307-306-4, InTech.
Senderowicz, et al., "Low-Voltage Double-Sampled Delta-Sigma Converters", IEEE Journal on Solid-State Circuits, Dec. 1997, pp. 1907-1919, vol. 32, No. 12, Piscataway, NJ.
Hurst, et al., "An improved double sampling scheme for switched-capacitor delta-sigma modulators", 1992 IEEE Int. Symp. on Circuits and Systems, May 10-13, 1992, vol. 3, pp. 1179-1182, San Diego, CA.
Parkins, John W., "Narrowband and broadband active control in an enclosure using the acoustic energy density" Acoustical Society of America, Jul. 2000, vol. 108, No. 1, pp. 192-203.
Jin, et al. "A simultaneous equation method-based online secondary path modeling algorithm for active noise control", Journal of Sound and Vibration, Apr. 25, 2007, pp. 455-474, vol. 303, No. 3-5, London, GB.
Erkelens, et al., "Tracking of Nonstationary Noise Based on Data-Driven Recursive Noise Power Estimation", IEEE Transactions on Audio Speech and Language Processing, Aug. 2008, pp. 1112-1123, vol. 16, No. 6, Piscataway, NJ, US.
Rao, et al., "A Novel Two State Single Channel Speech Enhancement Technique", India Conference (Indicon) 2011 Annual IEEE, IEEE, Dec. 2011, 6 pages (pp. 1-6 in pdf), Piscataway, NJ, US.
Rangachari, et al., "A noise-estimation algorithm for highly non-stationary environments", Speech Communication, Feb. 2006, pp. 220-231, vol. 48, No. 2. Elsevier Science Publishers.
Parkins, et al., "Narrowband and broadband active control in an enclosure using the acoustic energy density", J. Acoust. Soc. Am. Jul. 2000, pp. 192-203, vol. 108, issue 1, US.
Feng, Jinwei et al., "A broadband self-tuning active noise equaliser", Signal Processing, Elsevier Science Publishers B.V. Amsterdam, NL, vol. 62, No. 2, Oct. 1, 1997, pp. 251-256.
Zhang, Ming et al., "A Robust Online Secondary Path Modeling Method with Auxiliary Noise Power Scheduling Strategy and Norm Constraint Manipulation", IEEE Transactions on Speech and Audio Processing, IEEE Service Center, New York, NY, vol. 11, No. 1, Jan. 1, 2003.
Lopez-Gaudana, Edgar et al., "A hybrid active noise cancelling with secondary path modeling", 51st Midwest Symposium on Circuits and Systems, 2008, MWSCAS 2008, Aug. 10 2008, pp. 277-280.
Widrow, B., et al., Adaptive Noice Cancelling; Principles and Applications, Proceedings of the IEEE, Dec. 1975, pp. 1692-1716, vol. 63, No. 13, IEEE, New York, NY, US.
Morgan, et al., A Delayless Subband Adaptive Filter Architecture, IEEE Transactions on Signal Processing, IEEE Service Center, Aug. 1995, pp. 1819-1829, vol. 43, No. 8, New York, NY, US.

* cited by examiner

HEADPHONE RESPONSIVE TO OPTICAL SIGNALING

FIELD OF THE DISCLOSURE

The instant disclosure relates to mobile devices. More specifically, this disclosure relates to audio output of mobile devices.

BACKGROUND

Mobile devices, such as smart phones, are carried by a user throughout most or all of a day. These devices include the capability of playing music, videos, or other audio through headphones. Users often take advantage of having a source of music available throughout the day. For example, users often walk along the streets, ride bicycles, or ride motorized vehicles with headphones around their ears or headphone earbuds inserted in their ears. The use of the headphones impairs the user's ability to receive audible clues about the environment around them. For example, a user may be unable to hear the siren of an emergency vehicle while wearing the headphones with audio playing from the mobile device.

In addition to the physical impairment to audible sounds created by a user wearing the headphones, the mobile device and/or the headphones may implement noise cancellation. With noise cancellation, a microphone near the mobile device or headphones is used to detect sounds in the surrounding environment and intentionally subtract the sounds from what the user hears. Thus, when noise cancellation is active, the user only hears the audio from the device. For example, the mobile device or headphones may generate a signal that is out-of-phase with the sounds and add the out-of-phase signal to the music played through the headphones. Thus, when the environmental sound reaches the user's ear, the cancellation signal added to the music offsets the environmental sound and the user does not hear the environment. When the audible sound is the siren of an emergency vehicle, the user may be unaware of an emergency around him or may be unaware of an approaching high speed vehicle. This has become a particularly dangerous situation as noise cancellation in headphones has improved.

One conventional solution is for the mobile device to detect certain sounds, such as an emergency siren through the microphone and mute the audio output through the headphones while particular sounds are detected. However, this solution requires advance knowledge of each of the sounds. For example, a database of all emergency sirens would need to be created and updated regularly in order to recognize all emergency vehicles. Furthermore, the input from the microphone is noisy and the emergency siren may be covered by other nearby audible sounds, such as nearby car engines, generators, wildlife, etc. Thus, audibly detecting warning sounds may be difficult, and mute functionality based on audible detection of sounds may not be reliable.

Shortcomings mentioned here are only representative and are included simply to highlight that a need exists for improved audio devices and headphones, particularly for consumer-level devices. Embodiments described here address certain shortcomings but not necessarily each and every one described here or known in the art.

SUMMARY

Optical detection of particular signals identifying activity in a user's environment may be used to alert the user to certain activities. For example, emergency vehicles often include systems that generate optical signals, such as strobe lights. These optical signals may be detected and their presence used to take action by adjusting audio output of the headphones. These headphones may be paired with smart phones, tablets, media players, and other electronic devices. Sensors may be added to the headphones or to a device coupled to the headphones to detect optical signaling and take action in response to the detected optical signaling.

According to one embodiment, an apparatus may include an optical sensor and an audio controller coupled to the optical sensor. The audio controller may be configured to output an audio signal to an audio transducing device; detect an optical pattern corresponding to a presence of a vehicle in a signal received through the optical sensor; and/or adjust the output audio signal based, at least in part, on the detection of the optical pattern corresponding to the presence of the vehicle.

In some embodiments, the apparatus may also include a microphone coupled to the audio controller, and the microphone may receive an audio signal from the environment around the audio transducing device.

In certain embodiments, the audio controller may be configured to adjust the output audio signal by muting the output audio signal after the optical pattern is detected, turning off a noise cancellation signal within the audio signal after the optical pattern is detected, and/or adding to the output audio signal an audio signal corresponding to an audio signal representative of an environment around the audio transducing device after the optical pattern is detected; the optical sensor may be a visible light sensor or an infrared (IR) sensor; the audio controller may also be configured to generate an anti-noise signal for canceling audio, received through the microphone, in the environment around the audio transducing device using at least one adaptive filter, add to the output audio signal the anti-noise signal, and adjust the output audio signal by disabling the adding of the anti-noise signal to the output audio signal after the optical pattern is detected; the audio controller may also be configured to disable the detection of the optical pattern; the detected optical signal may correspond to a strobe of a traffic control preemption signal of an emergency vehicle; the optical sensor may be attached to a cord-mounted module attached to the apparatus; and/or the optical sensor may be attached to the audio transducing device.

According to another embodiment, a method may include receiving, at an audio controller, a first input corresponding to a signal received from an optical sensor; receiving, at the audio controller, a second input corresponding to an audio signal for playback through an audio transducing device; detecting, by the audio controller, a pattern indicating a presence of a vehicle in the first input; and/or adjusting, by the audio controller, the audio signal for playback through the audio transducing device after the pattern is detected.

In some embodiments, the method may also include receiving, at an audio controller, a third input corresponding to an audio signal received from a microphone in an environment around the audio transducing device; generating, by the audio controller, an anti-noise signal for canceling audio in the environment around the audio transducing device using at least one adaptive filter; detecting, by the audio controller, a vehicle strobe pattern in the first input; and/or disabling the detection of the pattern.

In certain embodiments, the step of adjusting the audio signal may include muting the output audio signal when the pattern is detected, turning off a noise cancellation signal within the audio signal when the pattern is detected, and/or adding to the output audio signal an audio signal corresponding to an audio signal representative of an environment around the audio transducing device when the pattern is detected; and/or the pattern may correspond to a strobe of a traffic control preemption signal of an emergency vehicle.

According to a further embodiment, an apparatus may include an optical sensor; an audio input node configured to receive an audio signal; an audio transducing device coupled to the audio input node; and/or a pattern discriminator coupled to the optical sensor and coupled to the audio transducing device. The pattern discriminator may be configured to detect a pattern indicating a presence of a vehicle at the optical sensor and/or mute the audio transducing device when the pattern is detected.

In some embodiments, the method may also include a controller configured to adjust an output audio signal of the audio transducing device based, at least in part, on the detection of the pattern.

In certain embodiments, the detected pattern may include a strobe of a traffic control preemption signal of an emergency vehicle; the optical sensor may include a visible light sensor or an infrared (IR) sensor; the optical sensor, the audio transducing device, and the pattern discriminator may be integrated into headphones; and/or the audio controller may be configured to adjust the output audio signal by turning off a noise cancellation signal within the audio signal after the pattern is detected or adding to the output audio signal an audio signal corresponding to an audio signal representative of an environment around the audio transducing device after the pattern is detected.

The foregoing has outlined rather broadly certain features and technical advantages of embodiments of the present invention in order that the detailed description that follows may be better understood. Additional features and advantages will be described hereinafter that form the subject of the claims of the invention. It should be appreciated by those having ordinary skill in the art that the conception and specific embodiment disclosed may be readily utilized as a basis for modifying or designing other structures for carrying out the same or similar purposes. It should also be realized by those having ordinary skill in the art that such equivalent constructions do not depart from the spirit and scope of the invention as set forth in the appended claims. Additional features will be better understood from the following description when considered in connection with the accompanying figures. It is to be expressly understood, however, that each of the figures is provided for the purpose of illustration and description only and is not intended to limit the present invention.

BRIEF DESCRIPTION OF THE DRAWINGS

For a more complete understanding of the disclosed system and methods, reference is now made to the following descriptions taken in conjunction with the accompanying drawings.

DETAILED DESCRIPTION

Figure 1:
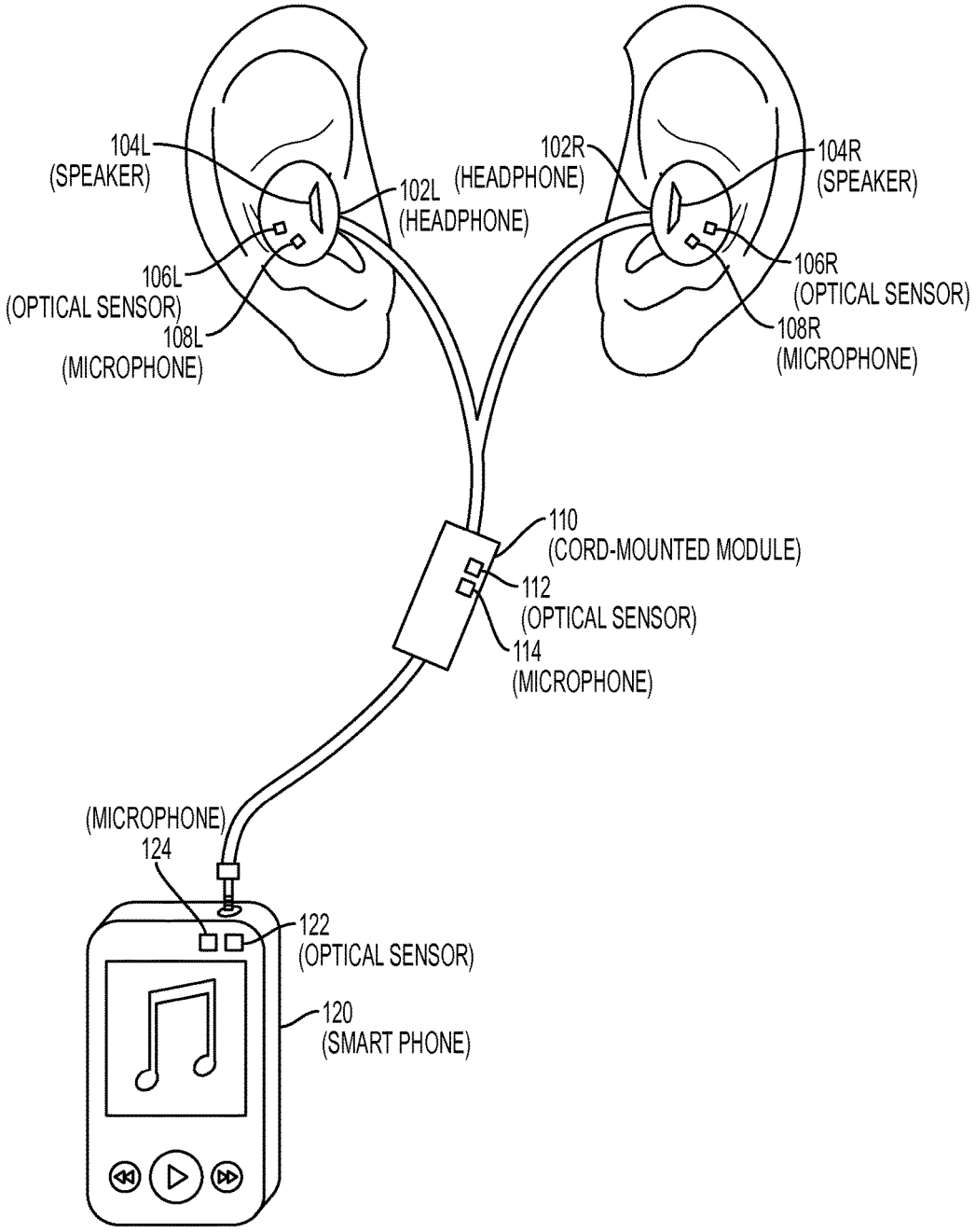
FIG. 1 is a drawing illustrating an audio system with an optical sensor embedded in the headphones, a cord-mounted module, and/or an electronic device according to one embodiment of the disclosure.

FIG. 1 is a drawing illustrating an audio system with an optical sensor embedded in the headphones, a cord-mounted module, and/or an electronic device according to one embodiment of the disclosure. Headphones 102L and 102R may be coupled to an electronic device 120, such as an MP3 player, a smart phone, or a tablet computer. The headphones 102L and 102R may include speakers 104L and 104R, respectively. The speakers 104R and 104L transduce an audio signal provided by the electronic device 120 into sound waves that a user can hear. The headphones 102L and 102R may also include optical sensors 106L and 106R, respectively. The optical sensors 106L and 106R may be, for example, infrared (IR) sensors or visible light sensors. The headphones 102L and 102R may further include microphones 108L and 108R, respectively.

Optical sensors may be included on components other than the headphones 102L and 102R. A cord-mounted module 110 may be attached to a wire for the headphones 102L and 102R and may include an optical sensor 112. The electronic device 120 coupled to the headphones 102L and 102R may also include an optical sensor 122. Although optical sensors 106L, 106R, 112, and 122 are illustrated, not all the optical sensors may be present. For example, in one embodiment the optical sensor 112 is the only optical sensor. In another embodiment, the optical sensor 122 is the only optical sensor.

Microphones may be included in the audio system for detecting environmental sounds. The microphone may be located on components other than the headphones 102L and 102R. The cord-mounted module 110 may also include a microphone 114, and the electronic device 120 may also include a microphone 124. Although microphones 108L, 108R, 114, and 124 are illustrated, not all the microphones may be present. For example, in one embodiment, the microphone 124 is the only microphone. In another embodiment, the microphone 114 is the only microphone.

Output from optical sensors 106L, 106R, 112, and 122 and microphones 108L, 108R, 114, and 124 may be provided to an audio controller (not shown) located in the headphones 104L, 104R, in the cord-mounted module 110, or in the electronic device 120. In one embodiment, the audio controller may be part of the electronic device 120 and constructed as an integrated circuit (IC) for the electronic device 120. The IC may include other components such as a generic central processing unit (CPU), digital signal processor (DSP), audio amplification circuitry, digital to analog converters (DACs), analog to digital converters (ADC), and/or an audio coder/decoder (CODEC).

The audio controller may process signals including an internal audio signal containing music, sound effects, and/or audio, an external audio signal, such as from a microphone signal, a down-stream audio signal for a telephone call, or a down-stream audio signal for streamed music, and/or a generated audio signal, such as an anti-noise signal. The audio controller may generate or control generation of an audio signal for output to the headphones 102L and 102R. The headphones 102L and 102R then transduce the generated audio signal into audible sound recognized by the user's ears. The audio controller may utilize signals from the optical sensors 106L, 106R, 112, and 122 to recognize specific patterns and take an action based on the detection of a specific pattern. For example, the audio controller may select input signals used to generate the audio signal based, at least in part, on the detection of a specific pattern in the signal from the optical sensors 106L, 106R, 112, and/or 122.

Figure 2:
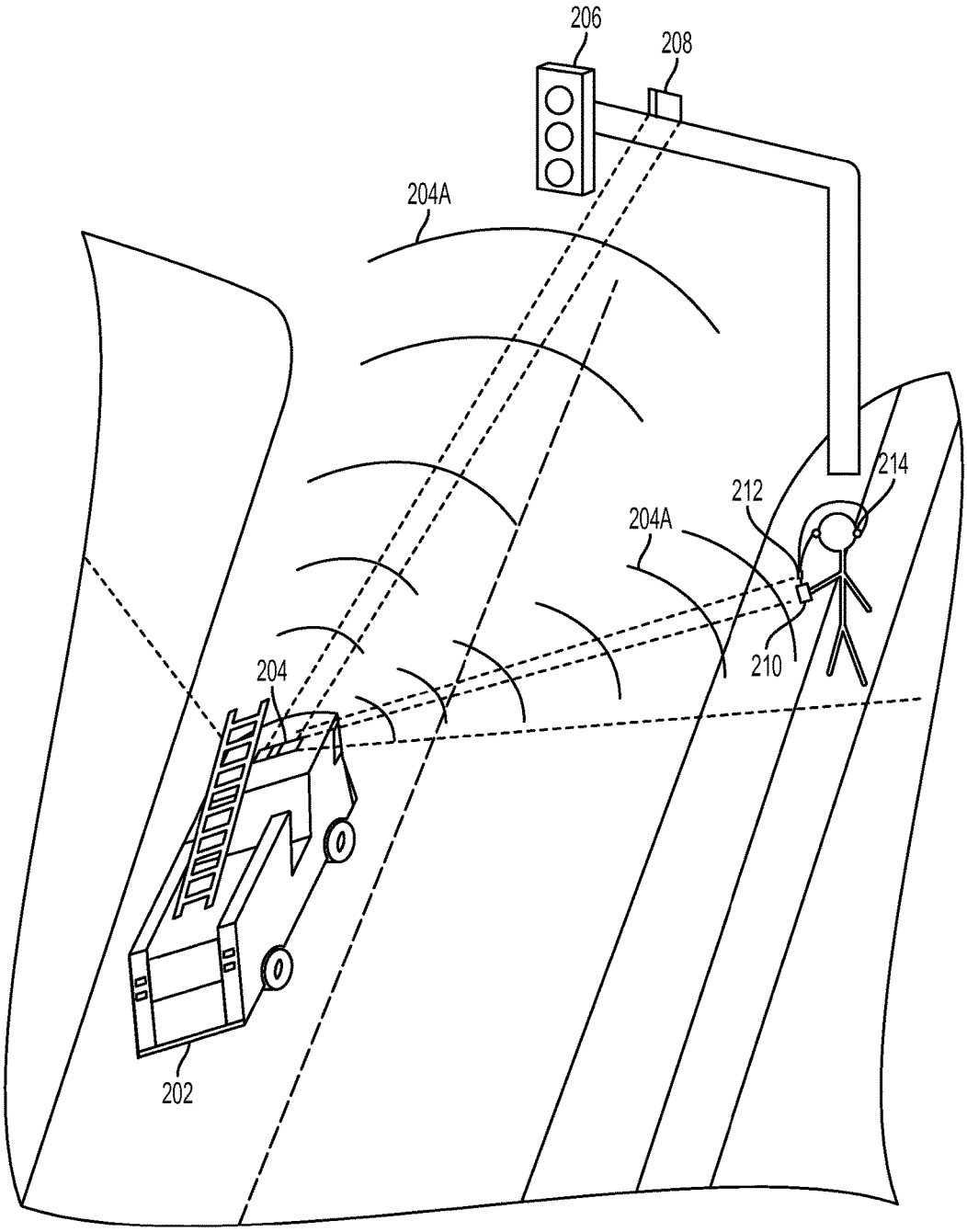
FIG. 2 is a drawing illustrating an emergency vehicle pattern as one optical signal that an optical sensor may detect according to one embodiment of the disclosure.

In one example, the specific pattern may be a signal corresponding to the presence of a vehicle, such as an emergency vehicle strobe signal. The optical sensors 106L, 106R, 112, and 122 may be configured to receive the optical signal, and the audio controller may be configured to discriminate and identify the optical signal. In one embodiment, the pattern discriminator is configured to recognize a strobe signal corresponding to an emergency vehicle traffic preemption signal. FIG. 2 is a drawing illustrating an emergency vehicle strobe as one optical signal that an optical sensor may detect according to one embodiment of the disclosure. An emergency vehicle 202, such as a fire truck or an ambulance, may generate strobe signals 204A from light elements 204. The strobe signal 204A activates a strobe signal detector 208 mounted with traffic light 206. The strobe signal detector 208 may cycle the traffic light 206 upon detection of the strobe signal 204A to allow the emergency vehicle 202 to pass through the intersection unimpeded.

A user may be walking alongside the road using smart phone 210 and headphones 214. With music playing through the headphones 214, the user may be unable to hear the approach of the emergency vehicle 202. An optical sensor 212 in the smart phone 210 may detect strobe signal 204A. When the smart phone 210 detects the strobe signal 204A, the smart phone 210 may adjust audio output through the headphones 214. For example, the smart phone 210 may mute the audio output through the headphones 214. In another example, the smart phone 210 may disable noise cancelling within the headphones 214 to allow the user to hear the emergency siren broadcast by the emergency vehicle 202. In a further example, the smart phone 210 may pass to the headphones 214 an audio signal from a microphone that is receiving the emergency siren.

Although the optical sensor 212 is shown on the smart phone 210, the optical sensor 212 may be alternatively placed on a cord-mounted module (not shown) or the headphones 214, as described above with reference to FIG. 1. Further, although the smart phone 210 is described as performing discrimination on the signal of optical sensor 212 and adjusting the audio output to the headphones 214, the processing may be performed by an audio controller housed in the headphones 214 or a cord-mounted module.

Figure 3:
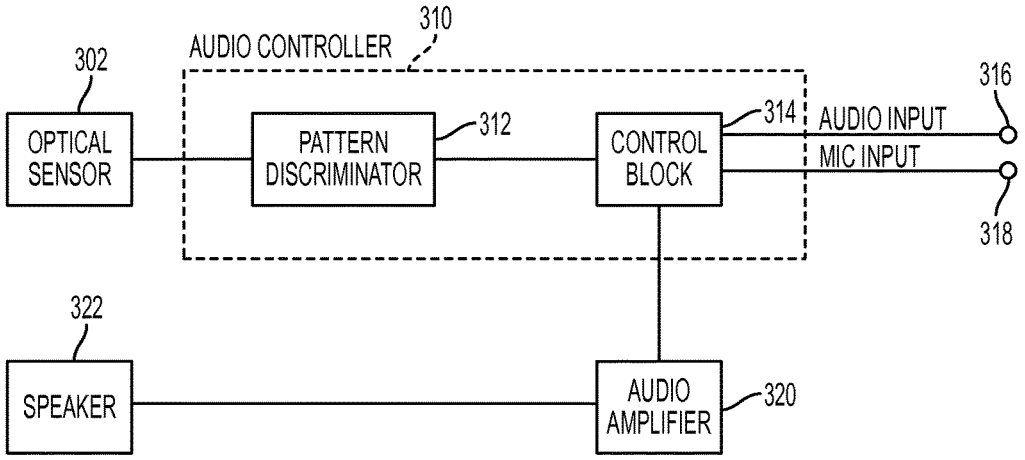
FIG. 3 is a block diagram illustrating an audio controller and optical sensor for controlling an output of a speaker according to one embodiment of the disclosure.

An audio controller, regardless of where it is located, may be configured to include several blocks or circuits for performing certain functions. FIG. 3 is a block diagram illustrating an audio controller and optical sensor for controlling an output of a speaker according to one embodiment of the disclosure. An audio controller 310 may include a pattern discriminator 312 and a control block 314. The pattern discriminator 312 may be coupled to an optical sensor 302 and be configured to detect certain patterns within the signals received from the optical sensor 302. For example, the pattern discriminator 312 may include a database of known patterns of emergency vehicles and attempt to match signals from the optical sensor 302 to a known pattern. The patterns may be set by standards or local authorities and may be a repeated flashing of light at a set frequency or a specific pattern of frequencies.

Signals may be identified by processing data received from the optical sensor 302 at the pattern discriminator 312 and/or the control block 314. In one example, the pattern discriminator 312 may count a number of flashes of the strobe signal within a fixed time window. In another example, a message in the received optical signal may be decoded using clock and data recovery. In a further example, the pattern discriminator 312 may perform analysis on a signal from the optical sensor 302 to determine the presence of a certain pattern. In one embodiment, the pattern discriminator 312 may perform a Fast Fourier Transform (FFT) on a signal received by optical sensor 302 and determine whether the received signal has a particular frequency component. A pattern discriminator 312 may also use FFT to detect a pattern of frequencies in the optical sensors.

When the pattern discriminator 312 receives a positive match, the pattern discriminator 312 transmits a control signal to the control block 314. The control block 314 may also receive an audio input from input node 316, which may be an internal audio signal such as music selected for playback on an electronic device. Further, the control block 314 may receive a microphone input from input node 318. The control block 314 may generate an audio signal for transmission to the audio amplifier 320 for output to the speaker 322. The control block 314 may generate the audio signal based on the match signal from the pattern discriminator 312. In one example, when a positive match signal is received, the control block 314 may adjust an audio signal output to the speaker 322. In one embodiment, when a positive match signal is received, the control block 314 may include only the microphone input in the audio signal transmitted to the speaker 322. This may allow the user to hear the emergency vehicle passing by. When a negative match signal is later received, the control block 314 may include only the audio input in the audio signal transmitted to the speaker 322, which allows the user to return to music playback.

Figure 4:
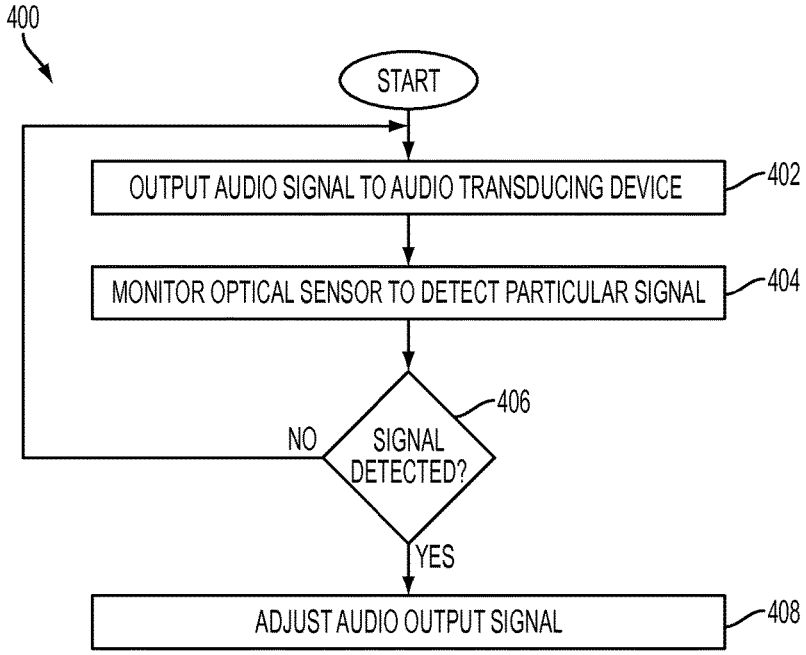
FIG. 4 is a flow chart illustrating a method of controlling headphones based on a pattern detected from an optical signal according to one embodiment of the disclosure.

A flow chart for operation of the control block 314 is shown in FIG. 4. FIG. 4 is a flow chart illustrating a method of controlling headphones based on a pattern detected from an optical signal according to one embodiment of the disclosure. A method 400 begins at block 402 with outputting an audio signal to an audio transducing device, such as speaker 322 of a headphone. At block 404, the optical sensor is monitored, such as through the pattern discriminator 312, to detect a particular signal. At block 406, it is determined whether the signal is detected. If no signal is detected, the method 400 returns to blocks 402 and 404. If the signal is detected at block 406, then the method 400 continues to block 408 to adjust the audio output signal, such as my muting an internal audio signal.

Figure 5:
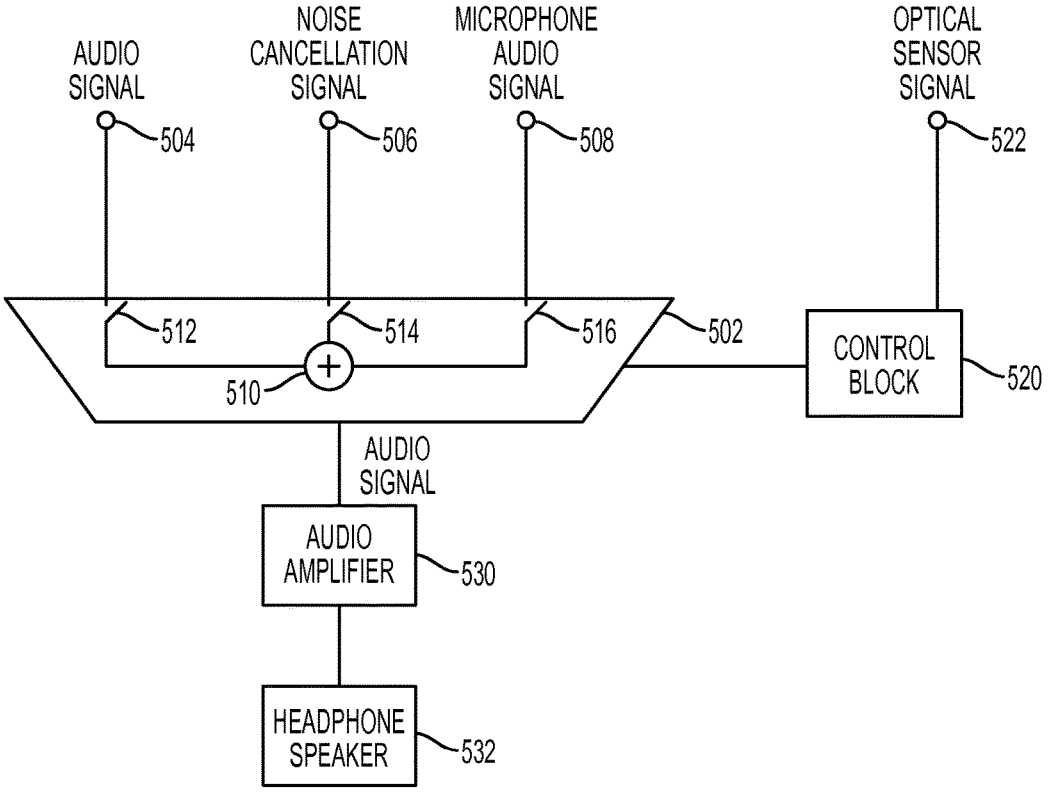
FIG. 5 is a block diagram illustrating an audio controller for mixing several signals for output to headphones based on a pattern detected from an optical signal according to one embodiment of the disclosure.

An audio controller may have several alternative actions available to adjust an audio signal when a signal is detected by the optical sensor. The action taken may be based, for example, on which particular pattern is detected within the optical sensor and/or a user preference indicated through a setting in the electronic device or a switch on the headphones. FIG. 5 is a block diagram illustrating an audio controller for mixing several signals for output to headphones based on a pattern detected from an optical signal according to one embodiment of the disclosure. A control block 520 may be coupled to an optical sensor signal through input node 522, such as through a pattern discriminator. The control block 520 may control the operation of a mux 502, which generates an audio signal for output to an audio amplifier 530 and a headphone speaker 532.

The mux 502 may include a summation block 510 with one or more input signals. The input signals may include an internal audio signal, such as music, received at an input node 504, a noise cancellation signal received at input node 506, and/or a microphone audio signal received at input node 508. The mux 502 may include switches 512, 514, and 516 to couple or decouple the input nodes 504, 506, and 508 from the summation block 510. The switches 512, 514, and 516 may be controlled by the control block 520 based, at least in part, on a match signal that may be received from the input node 522. For example, the control block 520 may mute the internal audio signal by disconnecting switch 512. In another example, the control block 520 may disable a noise cancellation signal by deactivating the switch 514. In a further example, the control block 520 may disable a noise cancellation signal by deactivating the switch 514 and pass through a microphone signal by activating the switch 516. In one embodiment, the noise cancellation signal received at input node 506 may be an adaptive noise cancellation (ANC) signal generated by an ANC circuit. Additional disclosure regarding adaptive noise cancellation (ANC) may be found in U.S. Patent Application Publication No. 2012/0207317 corresponding to U.S. patent application Ser. No. 13/310,380 filed Dec. 2, 2011 and entitled "Ear-Coupling Detection and Adjustment of Adaptive Response in Noise-Canceling in Personal Audio Devices" and may also be found in U.S. patent application Ser. No. 13/943,454 filed on Jul. 16, 2013, both of which are incorporated by reference herein.

Figure 6:
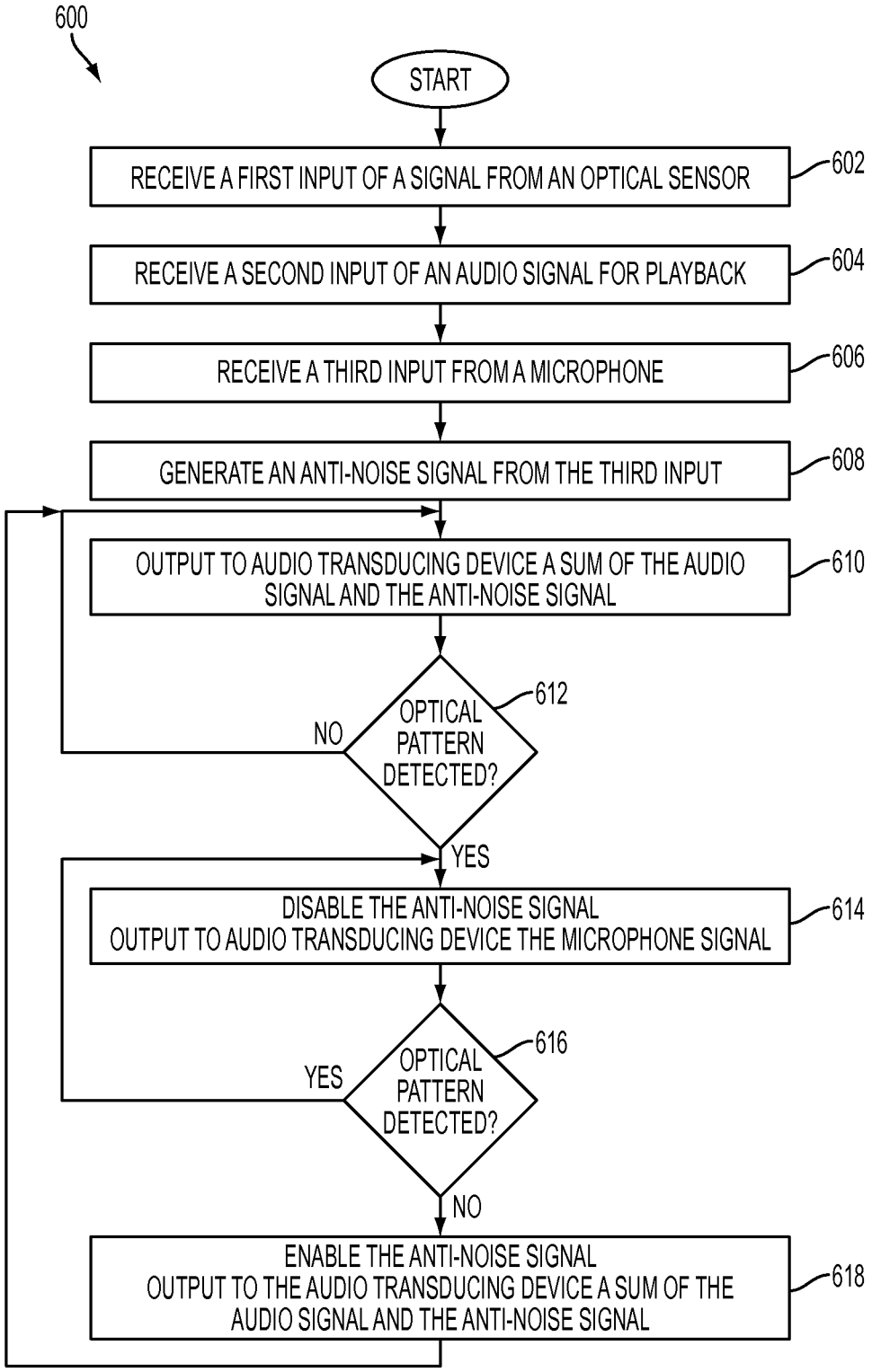
FIG. 6 is a flow chart illustrating a method of adjusting audio output with an anti-noise signal according to one embodiment of the disclosure.

When the control block 520 is configured, whether by user preference or in response to a particular detected optical pattern, to control noise cancellation, the control block 520 may be configured to execute the method shown in FIG. 6. FIG. 6 is a flow chart illustrating a method of adjusting audio output with an anti-noise signal according to one embodiment of the disclosure. A method 600 begins at block 602 with receiving a first input of a signal from an optical sensor, at block 604 with receiving a second input of an audio signal for playback, and at block 606 with receiving a third input from a microphone. At block 608, an anti-noise signal may be generated from the third input, either by the control block 520 or by another circuit under control of the control block 520. At block 610, the control block 520 may control a multiplexer to sum the audio signal received at the second input at block 604 and the anti-noise signal received from the third input at block 608. This summed audio signal may be transmitted to an amplifier for output at headphones.

At block 612, the control block 520 determines whether an optical pattern is detected. When the optical pattern is not detected, the control block 520 returns to block 610 to continue providing audio playback. When the optical pattern is detected, the method 600 continues to block 614 where the control block 520 may disable the anti-noise signal and select the microphone signal received at block 606 for output to the audio transducing device, such as the headphones. In one embodiment shown in FIG. 5, block 614 may involve the control block 520 deactivating the switches 512 and 514 and activating the switch 516.

At block 616, it is determined whether the optical pattern is still detected. As long as the optical pattern is detected, the method 600 may return to block 614 where the microphone signal is output to the headphones. When the optical pattern is no longer detected, such as after the emergency vehicle has passed the user, the method 600 may proceed to block 618. At block 618, the anti-noise signal and the audio signal are re-enabled and a sum of the audio signal and the anti-noise signal is output to the headphones. In one embodiment shown in FIG. 5, block 618 may involve activating the switches 512 and 514 and deactivating the switch 516. After the anti-noise signal and the audio signal are re-enabled, the method 600 may return to block 610 to playback the audio signal until an optical pattern is detected again at block 612.

If implemented in firmware and/or software, the functions described above, such as with reference to FIG. 4 and FIG. 6, may be stored as one or more instructions or code on a computer-readable medium. Examples include non-transitory computer-readable media encoded with a data structure and computer-readable media encoded with a computer program. Computer-readable media includes physical computer storage media. A storage medium may be any available medium that can be accessed by a computer. By way of example, and not limitation, such computer-readable media can comprise random access memory (RAM), read-only memory (ROM), Electrically Erasable Programmable Read-Only Memory (EEPROM), compact disc-read only memory (CD-ROM) or other optical disk storage, magnetic disk storage or other magnetic storage devices, or any other medium that can be used to store desired program code in the form of instructions or data structures and that can be accessed by a computer. Disk and disc includes compact discs (CD), laser discs, optical discs, digital versatile discs (DVD), floppy disks and blu-ray discs. Generally, disks reproduce data magnetically, and discs reproduce data optically. Combinations of the above should also be included within the scope of computer-readable media.

In addition to storage on computer readable medium, instructions and/or data may be provided as signals on transmission media included in a communication apparatus. For example, a communication apparatus may include a transceiver having signals indicative of instructions and data. The instructions and data are configured to cause one or more processors to implement the functions outlined in the claims.

Although the present disclosure and certain representative advantages have been described in detail, it should be understood that various changes, substitutions and alterations can be made herein without departing from the spirit and scope of the disclosure as defined by the appended claims. For example, although a strobe signal is described as one type of optical signal for detecting the presence of a vehicle, an audio controller may be configured to discriminate other types of optical signals. Moreover, the scope of the present application is not intended to be limited to the particular embodiments of the process, machine, manufacture, composition of matter, means, methods and steps described in the specification. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A headphone device, comprising:

an optical sensor configured to (a) receive an optical signal comprising a strobe pattern that corresponds to an emergency vehicle and (b) output a sensor signal; and an audio controller coupled to the optical sensor, wherein the audio controller is configured to:

output an audio signal to a transducer;

decode the sensor signal using clock and data recovery to obtain the strobe pattern from the sensor signal and to compare a characteristic of the decoded strobe pattern with a known pattern to detect a presence of the emergency vehicle; and adjust the output audio signal based, at least in part, on the detection of the presence of the emergency vehicle.

2. The headphone device of claim 1, wherein the audio controller is configured to adjust the output audio signal by at least one of:

muting the output audio signal after the presence of the emergency vehicle is detected;

turning off a noise cancellation signal within the audio signal after the presence of the emergency vehicle is detected; and adding to the output audio signal an audio signal corresponding to an audio signal representative of an environment around the transducer after the presence of the emergency vehicle is detected.

3. The headphone device of claim 1, wherein the optical sensor comprises at least one of a visible light sensor and an infrared (IR) sensor.

4. The headphone device of claim 1, wherein the apparatus further comprises a microphone coupled to the audio controller, wherein the microphone receives an audio signal from the environment around the transducer.

5. The headphone device of claim 4, wherein the audio controller is further configured to:

generate an anti-noise signal for canceling sounds in the environment around the transducer based, at least in part, on the microphone audio signal;

add to the output audio signal the anti-noise signal; and adjust the output audio signal by disabling the adding of the anti-noise signal to the output audio signal after the presence of the emergency vehicle is detected.

6. The headphone device of claim 1, wherein the audio controller is configured to disable the detection of the presence of the emergency vehicle.

7. The headphone device of claim 1, wherein the strobe pattern corresponds to a strobe of a traffic control preemption signal of an emergency vehicle.

8. The headphone device of claim 1, further comprising:

a first headphone;

a second headphone; and a wire coupling the first headphone and the second headphone to the audio controller, wherein the optical sensor is integrated with the wire.

9. A method, comprising:

receiving, at an optical sensor integrated into a headphone device, an optical signal comprising a strobe pattern that corresponds to an emergency vehicle;

receiving, at an audio controller, a first input comprising a sensor signal from the optical sensor;

receiving, at the audio controller, a second input corresponding to an audio signal for playback through a transducer of the headphone device;

decoding, by the audio controller, the sensor signal using clock and data recovery to obtain the strobe pattern from the sensor signal and to compare a characteristic of the decoded strobe pattern with a known pattern to detect the presence of the emergency vehicle; and adjusting, by the audio controller, the audio signal for playback through the transducer after the presence of the emergency vehicle is detected.

10. The method of claim 9, wherein the step of adjusting the audio signal comprises at least one of:

muting the output audio signal when the presence of the emergency vehicle is detected;

turning off a noise cancellation signal within the audio signal when the presence of the emergency vehicle is detected; and adding to the output audio signal an audio signal corresponding to an audio signal representative of an environment around the transducer when the presence of the emergency vehicle is detected.

11. The method of claim 9, further comprising:

receiving, at an audio controller, a third input corresponding to an audio signal received from a microphone in an environment around the transducer;

generating, by the audio controller, an anti-noise signal for canceling audio in the environment around the transducer based, at least in part, on the audio signal received from the microphone;

adding the anti-noise signal to the audio signal for playback through the transducer; and disabling the adding of the anti-noise signal to the output audio signal after the presence of the emergency vehicle is detected.

12. The method of claim 9, further comprising disabling detection of the presence of the emergency vehicle.

13. The method of claim 9, wherein the strobe pattern corresponds to a vehicle strobe of a traffic control preemption signal of an emergency vehicle.

14. A headphone device, comprising:

an optical sensor configured to (a) receive an optical signal comprising a strobe pattern that corresponds to an emergency vehicle and (b) output a sensor signal;

an audio input node configured to receive an audio signal; and a pattern discriminator coupled to the optical sensor to receive the sensor signal and configured to couple to a transducer, wherein the pattern discriminator is configured to:

decode the sensor signal using clock and data recovery to obtain the strobe pattern from the sensor signal and to compare a characteristic of the decoded strobe pattern with a known pattern to detect a presence of the emergency vehicle; and mute the transducer when the presence of the emergency vehicle is detected.

15. The headphone device of claim 14, wherein the strobe pattern comprises a strobe of a traffic control preemption signal of an emergency vehicle.

16. The headphone device of claim 14, wherein the optical sensor comprises at least one of a visible light sensor and an infrared (IR) sensor.

17. The headphone device of claim 14, further comprising a controller configured to adjust an output audio signal of the transducer based, at least in part, on the presence of the emergency vehicle.

18. The headphone device of claim 17, wherein the audio controller is configured to adjust the output audio signal by at least one of:

turning off a noise cancellation signal within the audio signal after the presence of the emergency vehicle is detected; and adding to the output audio signal an audio signal corresponding to an audio signal representative of an environment around the transducer after the presence of the emergency vehicle is detected.

19. The headphone device of claim 1, wherein the audio controller is configured to detect the presence of the emergency vehicle by performing a Fast Fourier Transform (FFT) on the sensor signal received from the optical sensor to determine whether the signal has a particular frequency component indicating the presence of an emergency vehicle.

20. The method of claim 9, wherein the step of detecting the presence of the emergency vehicle comprises performing a Fast Fourier Transform (FFT) on the sensor signal received from the optical sensor to determine whether the signal has a particular frequency component indicating the presence of an emergency vehicle.

21. The headphone device of claim 14, wherein the pattern discriminator is configured to detect the presence of the emergency vehicle by performing a Fast Fourier Transform (FFT) on the sensor signal received from the optical sensor to determine whether the signal has a particular frequency component indicating the presence of an emergency vehicle.

22. The headphone device of claim 1, wherein the audio controller is an integrated circuit comprising an audio coder/decoder (CODEC).

23. The headphone device of claim 14, wherein the pattern discriminator is integrated with an audio coder/decoder (CODEC).

* * * * *